United States Patent [19]

Konishi et al.

[11] Patent Number: 4,806,123

[45] Date of Patent: Feb. 21, 1989

[54] ELECTRICAL CONNECTOR DEVICE WITH A NUMBER OF TERMINALS

[75] Inventors: Kenjiro Konishi, Hiratsuka; Ken Obata, Tokyo, both of Japan

[73] Assignee: The Furukawa Electric Co., Ltd., Tokyo, Japan

[21] Appl. No.: 149,107

[22] Filed: Jan. 27, 1988

[30] Foreign Application Priority Data

Feb. 3, 1987 [JP] Japan ..... 62-13827[U]
Feb. 4, 1987 [JP] Japan ..... 62-24274
Mar. 9, 1987 [JP] Japan ..... 62-33150[U]

[51] Int. Cl.[4] ..... H01R 13/44
[52] U.S. Cl. ..... 439/595; 439/603
[58] Field of Search ..... 439/595, 594, 596, 603

[56] References Cited

U.S. PATENT DOCUMENTS 4,714,437 12/1987 Dyki ..... 439/595

FOREIGN PATENT DOCUMENTS 54-11515 5/1979 Japan .
61-7875 1/1986 Japan .

*Primary Examiner*—Gil Weidenfeld
*Assistant Examiner*—Paula Austin
*Attorney, Agent, or Firm*—Frishauf, Holtz, Goodman & Woodward

[57] ABSTRACT

An electrical connector device comprising male and female housings and terminal seating detecting means. Each of the housings includes retaining means protruding in the form of a cantilever from each of partition walls, which define terminal chambers arranged in the form of a matrix composed of a plurality of rows and columns, and resiliently bendable in a flexure space. As male terminals, contained individually in the terminal chambers, and female terminals, adapted to be connected to the male terminals, engage the retaining means, the terminals are prevented from slipping out of the chambers. The terminal seating detecting means is fitted into the flexure space of the retaining means when the terminals are contained in their corresponding terminal chambers so that they normally engage the retaining means. The detecting means for the male terminals is formed integrally with at least one integral planar portion for protecting the male terminals from collision with objects running toward them, and the female housing has a fitting groove bored therein and adapted to receive the planar portion.

13 Claims, 8 Drawing Sheets

ELECTRICAL CONNECTOR DEVICE WITH A NUMBER OF TERMINALS

BACKGROUND OF THE INVENTION

The present invention relates to an electrical connector device for connecting a number of male terminals, contained in a male housing, and their corresponding female terminals of the same number, contained in a female housing.

In conventional electrical connector devices of this type, terminals contained in housings are engaged individually with lances, and locking wedges are forced into allowance spaces for the flexure of the lances. By doing this, the lances are prevented from being deformed after the engagement with the terminals, and the terminals are prevented from being disengaged from the housings. Examples of these devices are disclosed in Japanese Patent Publication No. 54-11515 (U.S. Ser. No. 65,058, filed Aug. 19, 1970) and Japanese Utility Model Disclosure (Kokai) No. 61-7875 (U.S. Ser. No. 618,984 filed June 11, 1974 now U.S. Pat. No. 4,557,542). The locking wedges are designed so that they cannot be forced into the lance flexure spaces unless the terminals and the lances engage correctly. Accordingly, the wedges can serve also as terminal seating detecting pieces for detecting the condition of engagement of the terminals. Thus, by the use of these locking wedges, the terminals can be fitted correctly in the housings without the possibility of their being bent or damaged at the time of connection.

However, the male and female housings sometimes cannot be accurately aligned when the male and female terminals therein are connected, even though the terminals are normally retained by means of the locking wedges. In such a case, the end edges or other portions of the female housing may possibly run against the male terminals, thereby bending the same. If the bent male terminals are squeezed into the female terminals, these terminals will be rubbed against one another and damaged.

In order to solve such a problem, the female housing must be provided with grooves to receive planar bodies which are mounted on the male-housing side so as to extend along the male terminals. In an electrical connector device having a number of terminals, e.g., 9 or 16 terminals, however, a number of planar bodies must be provided in order to protect the terminals satisfactorily against deformation and the like. The female housing must be formed with many fitting grooves for these planar bodies, so that the locking wedges on the female-housing side must be divided into a number of pieces. Thus, the mounting work for these locking wedges requires much time and labor.

OBJECT AND SUMMARY OF THE INVENTION

The primary object of the present invention is to provide an electrical connector device, in which a number of male terminals contained in a male housing can be easily connected to female terminals of the same number contained in a female housing, without rubbing against one another.

Another object of the invention is to provide an electrical connector device with a number of terminals, designed so that whether the terminals are normally in engagement with lances in housings can be determined with ease.

Still another object of the invention is to provide an electrical connector device with a number of terminals, in which male and female terminals can be connected to one another so that a male housing is fitted in a female housing, without entailing an awkward situation such that the end edges or other portions of the female housing bend the male terminals by running against the same, even though the housings cannot be aligned accurately with each other, for example.

A further object of the invention is to provide an electrical connector device with a number of terminals, requiring a fewer members and easier to assemble.

According to the present invention, there is provided an electrical connector device which comprises a male housing formed with a plurality of male-terminal chambers adapted individually to contain male terminals; a female housing formed with female-terminal chambers as many as the male-terminal chambers, the female-terminal chambers corresponding individually to the male-terminal chambers and adapted individually to contain female terminals connected to the male terminals corresponding thereto; male-terminal seating detecting means; and female-terminal seating detecting means, the male housing including first retaining means protruding in the form of a cantilever from each of partition walls, which define the male-terminal chambers of the male housing, and resiliently bendable in a first flexure space, whereby the male terminals contained in the male-terminal chambers are prevented from slipping out therefrom as the male terminals engage the first retaining means, the female housing including second retaining means protruding in the form of a cantilever from each of partition walls, which define the female-terminal chambers of the female housing, and resiliently bendable in a second flexure space, whereby the female terminals contained in the female-terminal chambers are prevented from slipping out therefrom as the female terminals engage the second retaining means, the male-terminal seating detecting means being adapted to be fitted into the first flexure space when the male terminals are contained in their corresponding male-terminal chambers in a manner such that the male terminals normally engage the first retaining means, and the female-terminal seating detecting means being adapted to be fitted into the second flexure space when the female terminals are contained in their corresponding female-terminal chambers in a manner such that the female terminals normally engage the second retaining means.

The male-terminal seating detecting means of this connector device includes at least one integral planar portion adapted to extend parallel to the male terminals, from a connection-side end face of the male housing toward the female housing, when the male terminal seating detecting means is fitted normally in the first flexure space, an extended end of the planar portion being situated nearer to the female housing than the distal ends of the male terminals are, thereby protecting the male terminals from collision with objects running toward the male terminals; and the female housing has at least one fitting groove bored therein so as to open to a connection-side end face thereof and adapted to receive the planar portion.

Preferably, the male- and female-terminal chambers are arranged in the form of a matrix composed of a plurality of rows and a plurality of columns, and the first and second flexure spaces corresponding to the male- and female-terminal chambers in each row communicate with one another so as to extend parallel to an array of the male- or female-terminal chambers in the row.

Preferably, moreover, the male-terminal seating detecting means includes male-terminal seating detecting pieces adapted to be fitted into the first flexure spaces corresponding individually to the rows, the male-terminal seating detecting pieces being coupled together by means of at least one rib member extending at right angles thereto; and the planar portion is formed so as to extend along the rib member. On the other hand, the female-terminal seating detecting means includes female-terminal seating detecting pieces adapted to be fitted into the second flexure spaces corresponding individually to the rows, and a frame fitted around the plurality of female-terminal chambers and formed integrally with the female-terminal seating detecting pieces to support the same.

Preferably, furthermore, the planar portion and each of the female-terminal seating detecting pieces have a slit or are cut in the position where they interfere with each other, and at least one of the cut female-terminal seating detecting pieces is supported by a rib member extending at right angles thereto and having one end coupled to the frame.

The above and other objects, features, and advantages of the invention will be more apparent from the ensuing detailed description taken in connection with the accompanying drawings.

DETAILED DESCRIPTION

Figure 1:
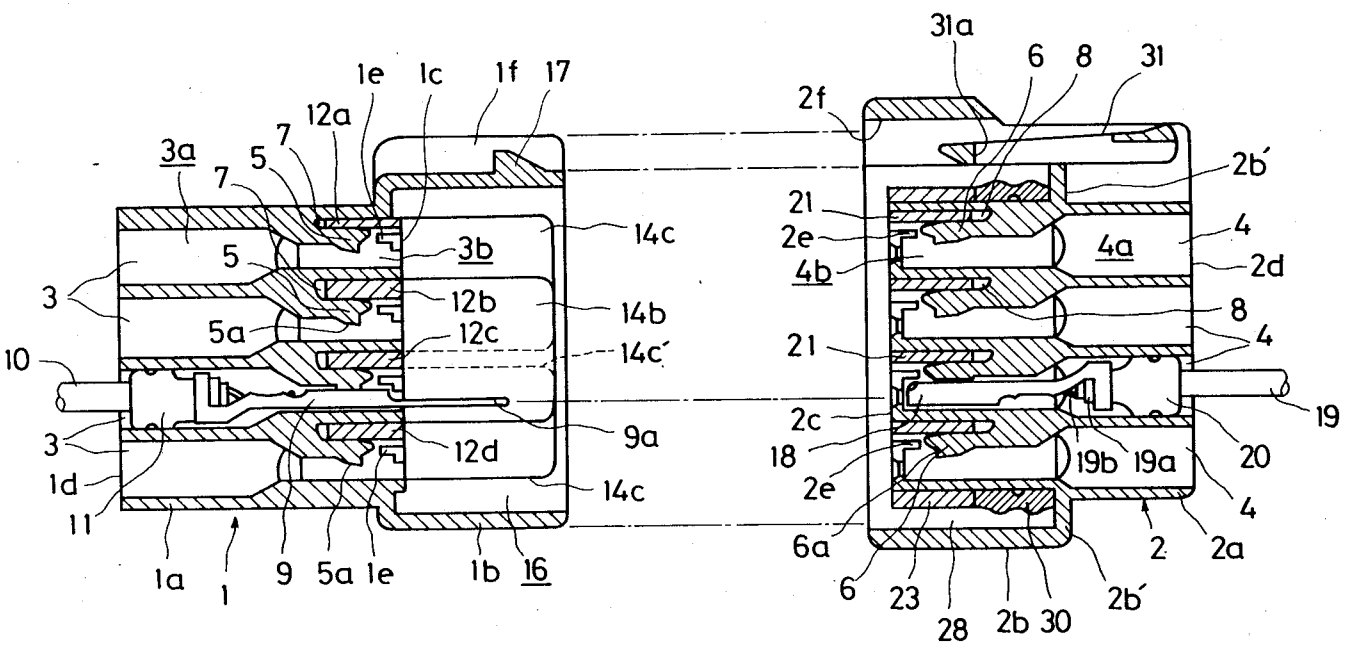
FIG. 1 is a longitudinal sectional view of an electrical connector device of a 16-terminal type according to a first embodiment of the present invention, showing a state before male and female housings 1 and 2 are connected.
Figure 2:
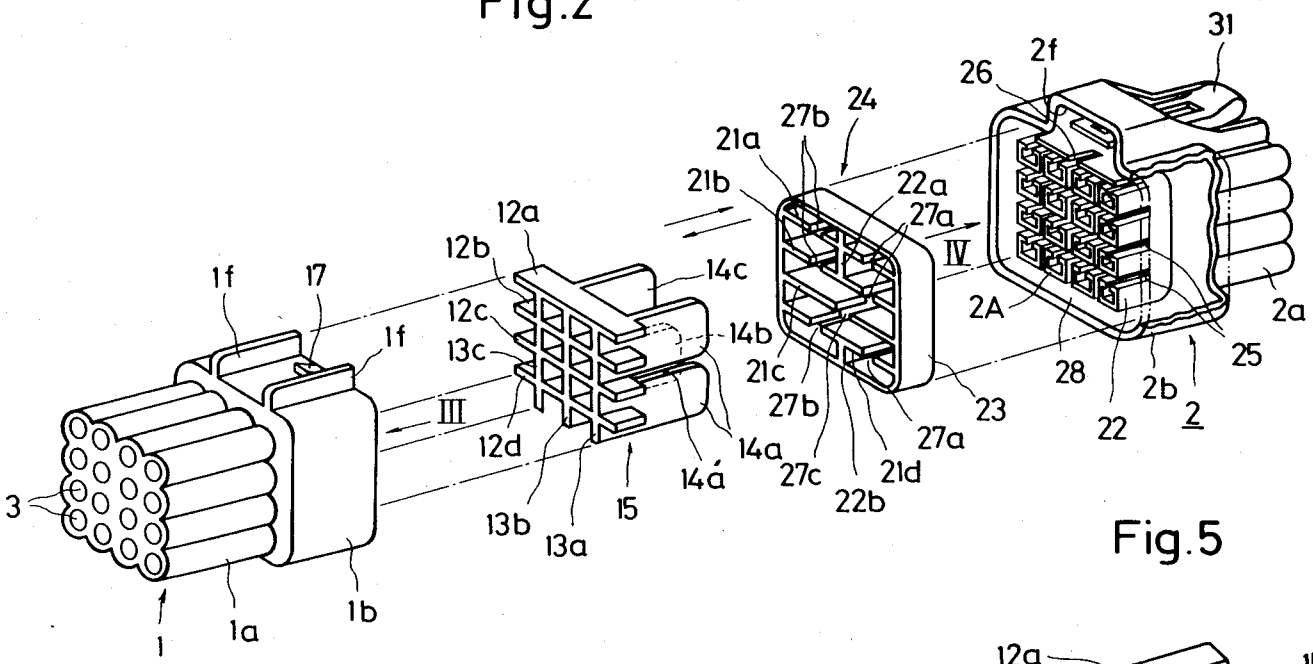
FIG. 2 is an exploded perspective view of the electrical connector device shown in FIG. 1.
Figure 5:
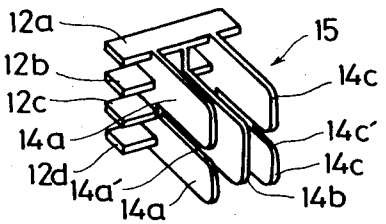
FIG. 5 is a perspective view of a male-side lance support 15 shown in FIG. 2, as taken from a different angle.

FIGS. 1 to 4 show an electrical connector device having 16 terminals. This connector device comprises a male housing 1 and a female housing 2 which are to be connected to each other. These housings are formed of nonconductive synthetic resin. The male housing 1 includes a housing body 1*a*, substantially shaped like a rectangular prism, and a skirt portion 1*b* in the form of a square tube. The skirt portion 1*b* extends from that portion of the outer peripheral wall of the housing body 1*a* near a connection-side end face 1*c* thereof toward the female housing 2 to which the skirt portion 1*b* is to be connected. Likewise, the female housing 2 includes a housing body 2*a*, substantially shaped like a rectangular prism, and a skirt portion 2*b* in the form of a square tube. The skirt portion 1*b* of the male housing 1 is adapted to be fitted in the skirt portion 2*b* of the female housing 2. The skirt portion 2*b* extends from a raised portion 2*b*′ toward the male housing 1 to which it is to be connected. The raised portion 2*b*′ protrudes outward from the substantially central portion of the outer peripheral wall of the housing body 2*a*, at right angles thereto. Terminal chambers 3 are defined inside the housing body 1*a* of the male housing 1, while terminal chambers 4, as many as the chambers 3, are defined inside the housing body 2*a* of the female housing 2.

Figure 3:
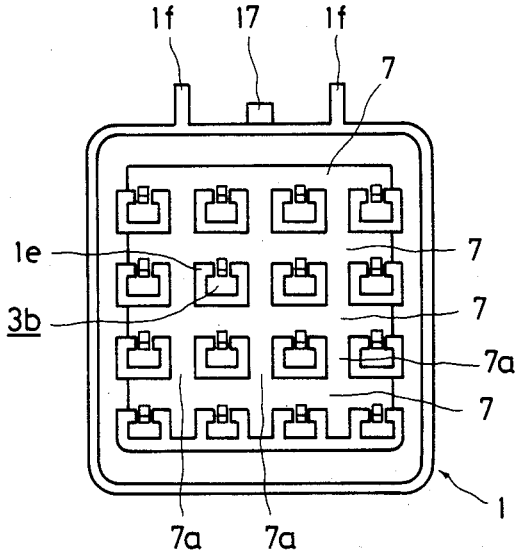
FIG. 3 is a front view of a connection-side end face of a male housing as taken in the direction of arrow III of FIG. 2.

The terminal chambers 3 in the housing body 1*a* of the male housing 1 are arranged in the form of a 4-row, 4-column matrix, and are 16 in total number. Each chamber 3 is composed of a cylindrical chamber 3*a* and a square tubular chamber 3*b* having a substantially rectangular cross section. The cylindrical chamber 3*a* opens to that end face 1*d* of the housing body 1*a* on the side of lead wires 10 (or on the opposite side to the connection-side end face 1*c*). The tubular chamber 3*b* communicates smoothly with the chamber 3*a* and opens to the end face 1*c*. A detecting piece holding groove 7 extends horizontally or parallel to each horizontal array of terminal chambers 3 and over each tubular chamber 3*b*, as shown in FIGS. 1 and 3. The groove 7 serves both as an allowance space for the flexure of its corresponding one of lances 5, which will be mentioned later, and as a holding space for its corresponding one of terminal seating detecting pieces 12*a*, 12*b*, 12*c* and 12*d*. The grooves 7 open to the connection-side end face 1*c* on the side of the female housing 2. Each of top walls 1*e* individually defining the tubular chambers 3*b* are cut along the center line of each corresponding chamber 3*b*, so that the chambers 3*b* communicate with their corresponding holding grooves 7.

Each lance 5 protrudes in the form of a cantilever from that portion of the top wall of its corresponding detection piece holding groove 7 near the junction of the corresponding cylindrical and tubular chambers 3*a* and 3*b*. The proximal end portion of the lance 5 hangs down from the top wall, while its distal end portion extends along the cut portion of each corresponding tubular chamber 3*b* toward the connection-side end face 1*c*. A projection 5*a* is formed on the lance 5, near the distal end thereof, so as to project into the tubular chamber 3*b*.

Figure 4:
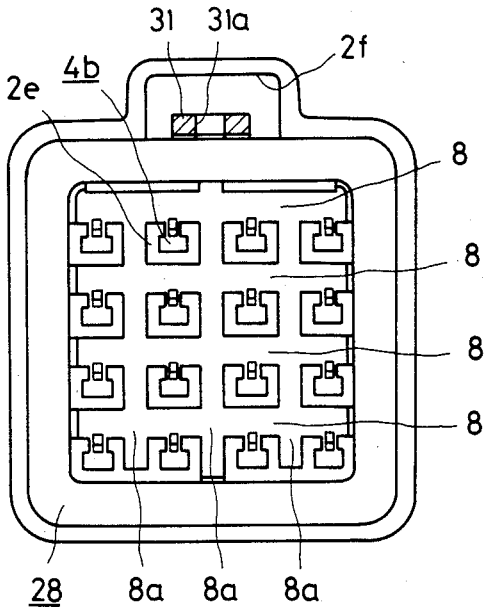
FIG. 4 is a front view of a connection-side end face of a female housing as taken in the direction of arrow IV of FIG. 2.

The terminal chambers 4 in the housing body 2*a* of the female housing 2 are also arranged in the form of a 16-compartment matrix, individually corresponding in position to the terminal chambers 3 of the male housing 1. Each chamber 4 is composed of a cylindrical chamber 4*a* and a square tubular chamber 4*b* having a substantially rectangular cross section. The cylindrical chamber 4*a* opens to that end face 2*d* of the housing body 2*a* on the side of lead wires 19 (or on the opposite side to a connection-side end face 2*c*). The tubular chamber 4*b* communicates smoothly with the chamber 4*a* and opens to the end face 2*c*. A detecting piece holding groove 8 extends horizontally or parallel to each horizontal array of terminal chambers 4 and over each tubular chamber 4*b*, as shown in FIGS. 1 and 4. The groove 8 serves both as an allowance space for the flexure of its corresponding one of lances 6, which will be mentioned later, and as a holding space for its corresponding one of terminal seating detecting pieces 21. The grooves 8 open to the connection-side end face 2*c* on the side of the male housing 1. Each of top walls 2*e* individually defining the tubular chambers 4*b* are cut along the center line of each corresponding chamber 4*b*, so that the chambers 4*b* communicate with their corresponding holding grooves 8.

Each lance 6 protrudes in the form of a cantilever from that portion of the top wall of its corresponding detecting piece holding groove 8 near the junction of the corresponding cylindrical and tubular chambers 4*a* and 4*b*. The proximal end portion of the lance 6 hangs down from the top wall, while its distal end portion extends along the cut portion of each corresponding tubular chamber 4*b* toward the connection-side end face 2*c*. A projection 6*a* is formed on the lance 6, near the distal end thereof, so as to project into the tubular chamber 4*b*.

A female terminal 18 is inserted in each terminal chamber 4 of the female housing 2. As the projection 6*a* of each lance 6 engages a retaining hole 18*c* (see FIGS. 10 and 11) in its corresponding female terminal 18, the terminal 18 is prevented from slipping out of the terminal chamber 4. A conductor end portion 19*b* of each lead wire 19 is connected to its corresponding female terminal 18 by pressure-bonding. A rubber plug 20 (described in detail later) is fitted on a covered end portion 19*a* of each lead wire 19. The rubber plug 20, along with the lead wire 19, is fixed to the female terminal 18 by pressure-bonding. The plug 20 is fitted in the cylindrical chamber 4*a* so that the terminal chamber 4 is sealed in a liquid-tight manner.

Figure 6:
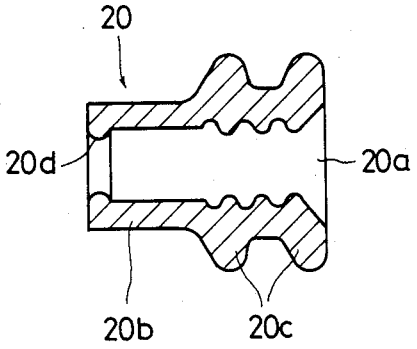
FIG. 6 is an enlarged sectional view of a rubber plug 20 shown in FIG. 1.
Figure 7:
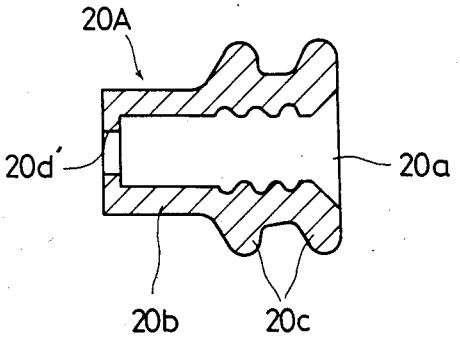
FIG. 7 is an enlarged sectional view showing a modification of the rubber plug 20 shown in FIG. 6.

Referring now to FIGS. 6 to 9, 16 and 17, the method of connection between each female terminal 18 and its corresponding lead wire 19 will be described. FIG. 6 shows a profile of the rubber plug 20, which is adapted to be fitted on the covered end portion 19*a* of the lead wire 19 and connected to the female terminal 18 by pressure-bonding. The rubber plug 20 has a bore 20*a* through which the lead wire 19 is passed along the central axis thereof. The plug 20 is composed of a sleeve portion 20*b* formed at one end portion thereof, on the female-terminal side, and flange portion 20*c* formed at the other end side and having an outside diameter larger than that of the sleeve portion 20*b*. The rubber plug 20 used in the electrical connector device of the present invention differs from a prior art rubber plug 20C, shown in FIG. 16, in that a ring-shaped bank portion 20*d*, smaller in inside diameter than the bore 20*a*, is formed along the inner end edge of the sleeve portion 20*b*. The inner end edge of the flange portion 20*c* is widened toward the opening side for the ease of insertion of the lead wire 19.

Figure 16:
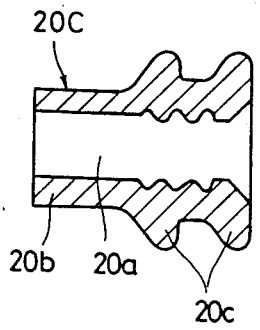
Fig.16 (PRIOR ART)
FIG. 16 is an enlarged sectional view of a rubber plug used in a prior art electrical connector device.

The profile of the bank portion 20*d* is not limited to the semicircular configuration as shown in FIG. 6. In a rubber plug 20A shown in FIG. 7, a bank portion 20*d'* is rectangular in shape. As regards the arrangement of other components, the rubber plug 20A of FIG. 7 and the prior art rubber plug 20C of FIG. 16 are constructed in the same manner as the rubber plug 20 shown in FIG. 6. In these three drawings, therefore, like reference numerals refer to like portions throughout the views.

The lead wire 19 is inserted into the through bore 20*a* of the rubber plug 20 (20A), from the side of the flange portion 20*c*, so that the plug 20 is fitted on the covered end portion 19*a* of the wire 19. The exposed conductor end portion 19*b* of the lead wire 19 is pressed against a wire barrel 18*a* of the female terminal 18. The covered end portion 19*a* is held under pressure by an insulation barrel 18*b* of the terminal 18, with the aid of the sleeve portion 20*b* of the rubber plug 20. In this state, the outer end edge of the sleeve portion 20*b* bulges so that its outside diameter is greater than that of the insulation barrel 18*b*, after the pressure-bonding, at least by a margin corresponding to the height of the bank portion 20*d*.

Figure 17:
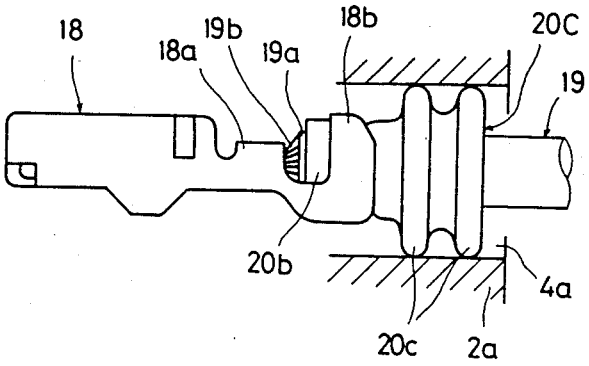
Fig.17 (PRIOR ART)
FIG. 17 is a side view showing the way the prior art rubber plug shown in FIG. 16 is used.

Unlike the rubber plug 20 shown in FIG. 6, the prior art rubber plug 20C is not provided with the bank portion 20*d*. Therefore, if the rubber plug 20C is urged to slip off the lead wire 19 when the female terminal 18 is inserted into the terminal chamber 4, as shown in FIG. 17, or in other case, the plug 20C will be disengaged from the insulation barrel 18*b*.

Figure 8:
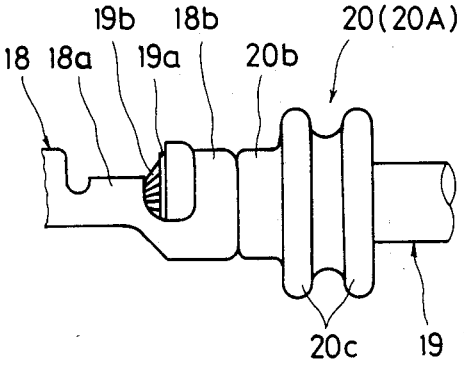
FIG. 8 is a side view showing the way the rubber plug of FIGS. 6 or 7 is used.
Figure 9:
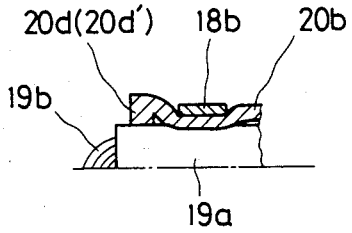
FIG. 9 is a sectional view of the principal part of the rubber plug of FIGS. 6 or 7, showing the way the plug is used.

If the rubber plug 20 (20A) used in the electrical connector device of the present invention, on the other hand, is urged to slip off the lead wire 19 when the female terminal 18 is inserted into the terminal chamber 4, as shown in FIGS. 8 and 9, or in some other case, the bank portion 20*d* (20*d'*) serves as a hook, so that the plug 20 (20A) cannot be disengaged from the insulation barrel 18*b*. Since the covered end portion 19*a* of the lead wire 19 is clamped by the bank portion 20*d* (20*d'*), moreover, the rubber plug 20 (20A) can be effectively prevented from moving before the pressure-bonding by means of the insulation barrel 18*b*, and the waterproofness of the lead wire 19 can be improved after the pressure-bonding.

Returning now to FIG. 1, the male terminals 9 are inserted individually into the terminal chambers 3 of the male housing 1. As the projection 5*a* of each lance 5 is fitted in a retaining hole (not shown) of its corresponding male terminal 9, the terminal 9 is prevented from slipping out of the terminal chamber 3. When the male terminal 9 is fitted correctly in the terminal chamber 3, a distal end portion 9*a* of the terminal 9 projects from the connection-side end face 1*c* of the housing body 1*a* into a space 16 surrounded by the skirt portion 1*b*. The conductor end portion of each lead wire 10 is connected to its corresponding male terminal 9 by pressure-bonding. A rubber plug 11, similar to the one fitted on each female terminal 18, is fitted on the covered end portion of each lead wire 10, and is fixed together therewith to the male terminal 9 by pressure-bonding. The plug 11 is fitted in the cylindrical chamber 3*a* so that the terminal chamber 3 is sealed in a liquid-tight manner.

Vertical ribs 13*a*, 13*b* and 13*c* of a male-side lance support 15 (mentioned later) are fitted individually in three vertical grooves 7*a*, which are bored between the adjacent columns of the terminal chambers 3 of the male housing 1. The upper end of each groove 7*a* communicates with that detecting piece holding groove 7 which corresponds to the uppermost row of the terminal chambers 3, while the lower end of the groove 7*a* extends to the bottom of the lowermost row of the chambers 3.

The terminal seating detecting pieces 12*a* to 12*d* and the vertical ribs 13*a* to 13*c* are inserted into their corresponding detecting piece holding grooves 7 and vertical grooves 7*a*. The detecting pieces 12*a* to 12*d*, which are as many as the holding grooves 7, and the three vertical ribs 13*a* to 13*c* are arranged integrally in parallel crosses. Planar bodies 14*a* and 14*c*, which serve to prevent deformation of the male terminals 9, extend integrally along the vertical ribs 13*a* and 13*c*, respectively, toward the female housing 2. Each of the planar bodies 14*a* and 14*c* has the same length and the same thickness as each of the vertical ribs 13*a* and 13*c*. The planar bodies 14*a* and 14*c* are formed with slits 14*a*' and 14*c*', respectively, which correspond in position to the third terminal seating detecting piece 12*c* from the top. The slits 14*a*' and 14*c*' enable the planar bodies 14*a* and 14*c* to avoid interfering with a terminal seating detecting piece 21*c* (mentioned later) on the female-housing side. A planar body 14*b* extends integrally along the central vertical rib 13*b* toward the female housing 2. The planar body 14*b* has a length ranging substantially between the respective upper end edges of the second and lowermost terminal seating detecting pieces 12*b* and 12*d*, and is as thick as the vertical rib 13*c*. The planar bodies 14*a* to 14*c* are designed so that they are higher than the distal end portion 9*a* of the male terminal 9, which projects from the connection-side end face 1*c* of the male housing 1, by a predetermined length, and are a little lower than the skirt portion 1*b* when the terminal seating detecting pieces 12*a* to 12*d* are inserted correctly into their corresponding detecting piece holding pieces 7. The detecting pieces 12*a* to 12*d*, the vertical ribs 13*a* to 13*c*, and the planar bodies 14*a* to 14*c* constitute the male-side lance support 15.

The planar bodies 14*a* to 14*c* of the male-side lance support 15 and vertical ribs 22*a* and 22*b* of a female-side lance support 24 (mentioned later) are fitted individually in three vertical grooves 8*a* (FIG. 4), which are bored between the adjacent columns of the terminal chambers 4 of the female housing 2. The upper end of each groove 8*a* communicates with that detecting piece holding groove 8 which corresponds to the uppermost row of the terminal chambers 4, while the lower end of the groove 8*a* extends to the bottom of the lowermost row of the chambers 4.

The female-side lance support 24 is composed of terminal seating detecting pieces 21*a* to 21*d*, adapted to be inserted into their corresponding detecting piece holding grooves 8, and a frame 23 for supporting these detecting pieces 21*a* to 21*d*. The frame 23 is fitted on the outer peripheral wall of the housing body 2*a* of the female housing 2, at that portion thereof which corresponds to the tubular chambers 4*b*. The detecting pieces 21*a* to 21*d* are supported between two opposite side walls of the frame 23 so as to be integral therewith. As mentioned later, moreover, the detecting pieces 21*a* to 21*d* are cut at their interference positions in order to avoid interfering with the planar bodies 14*a* to 14*c* of the male-side lance support 15 when the male and female housings 1 and 2 are connected. More specifically, the terminal seating detecting pieces 21*a*, 21*b* and 21*d* are cut at two symmetrical positions in order to avoid interfering with the planar bodies 14*a* and 14*c*, and gap portions 27*a* and 27*b* are formed at the individual cut positions. The respective central portions of the divided detecting pieces 21*a* and 21*b* are connectedly supported on the top wall of the frame 23 by means of the vertical rib 22*a*, while that of the detecting piece 21*d* is connectedly supported on the bottom wall of the frame 23 by means of the vertical rib 22*b*. The vertical ribs 22*a* and 22*b* are both fitted in the central vertical groove 8*a* of the female housing 2. Meanwhile, the detecting-piece 21*c* is cut at it central position in order to avoid interfering with the planar body 14*b*, and a gap portion 27*c* is formed at this cut position.

The terminal chambers 4 are surrounded by a gap 28 which is defined between the skirt portion 2*b* and the housing body 2 of the female housing 2. The skirt portion 1*b* of the male housing 1 is adapted to be fitted into the gap 28. In the female housing 2, the central portion of the top wall of the skirt portion 2*b* bulges angularly outward, thus forming a guide groove 2*f*. In the male housing 1, on the other hand, the top wall of the skirt portion 1*b* is formed with two guide rails 1*f*, which is adapted individually to engage the inner surfaces of the side walls of the guide groove 2*f*.

That part of the skirt portion 2*b* of the female housing 2 which constitutes the guide groove 2*f* is cut at the rear, so that the gap 28 opens to the side of the lead wires 19. At this opening portion, a retaining piece 31, having a retaining hole 31*a* in the center, is formed integrally with the raised portion 2*b*'. The retaining piece 31 is swingable around the raised portion 2*b*'. In the male housing 1, a projection 17 protrudes upward from the central part of the top wall of the skirt portion 1*b*. When the male and female housings 1 and 2 are coupled together, the projection 17 engages the retaining hole 31*a* of the retaining piece 31.

Figure 10:
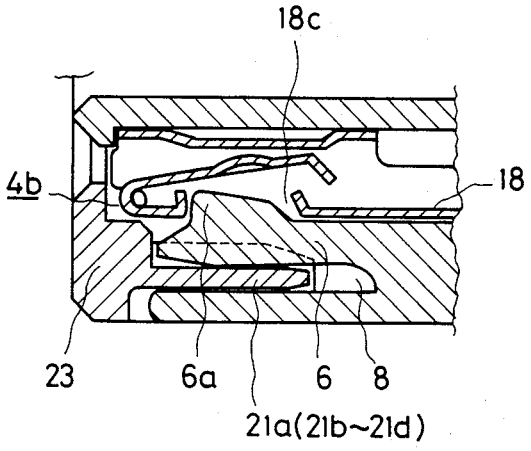
FIG. 10 is an enlarged sectional view of a principal part of the device of FIG. 1, showing an assembled state in which a female terminal 18 is fitted in position in a female-terminal chamber 4 of the female housing 2.
Figure 11:
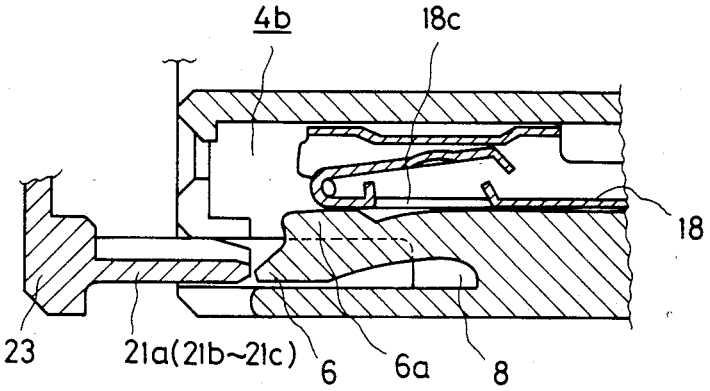
FIG. 11 is an enlarged sectional view of the principal part, showing a different assembled state in which the female terminal 18 is not fitted in position in the female-terminal chamber 4 of the female housing 2.

In the electrical connector device constructed in this manner, the male and female terminals 9 and 18, contained in the male and female housings 1 and 2, are connected in the following manner. First, a rubber seal ring 30 is fitted into the gap 28 of the female housing 2 so that it is intimately in contact with the outer surface of the peripheral wall of the housing body 2*a*, and that its end face abuts against the raised portion 2*b*'. Then, the female terminals 18, attached individually to the lead wires 19 and fitted with the rubber plugs 20, are inserted into regular positions in their corresponding terminal chambers 4 of the female housing 2, from the cylindrical-chamber side, and are caused to engage the lances 6. Thereafter, the terminal seating detecting pieces 21*a* to 21*d* of the female-side lance support 24 are inserted into their corresponding detecting piece holding grooves 8. If all the female terminals 18 are inserted correctly in the terminal chambers 4, as shown in FIG. 10, the projections 6*a* of the lances 6 engage the retaining holes 18*c* of their corresponding female terminals 18. Thus, the holding grooves 8 enjoy wide enough spaces for the insertion of the detecting pieces 21*a* to 21*d*. If any of the female terminals 18 fails to be inserted in position, its corresponding lance 6 will be left bent toward the corresponding holding groove 8. Therefore, the holding grooves 8 cannot secure sufficient spaces for the insertion of the detecting pieces 21*a* to 21*d*, so that these detecting pieces are prevented from entering the grooves 8 by the lances 6. Thus, whether the male terminals 18 are correctly fitted into and locked to their respective regular positions in the terminal chambers 4 can be determined by only inserting the terminal seating detecting pieces 21*a* to 21*d* together into the detecting piece holding grooves 8.

Once the terminal seating detecting pieces 21*a* to 21*d* are inserted into the detecting piece holding grooves 8, the female terminals 18 cannot be disengaged from the terminal chambers 4 unless the lances 6 are externally compulsorily bent toward the holding grooves 8 to disengage the projections 6*a* from the retaining holes 18*c* of the female terminals 18. In this connection, if the female terminals 18 are urged to be drawn out after they are inserted into the regular positions in the terminal chambers 4, a force acting on the engaging points between the retaining holes 18*c* of the female terminals 18 and the projections 6*a* produces a moment in a direction such that the lances 6 are bent toward the tubular chambers 4*b* of the terminal chambers 4. Accordingly, the projections 6*a* stick into their corresponding retaining holes 18*c*. Thus, the female terminals 18 cannot be drawn out of the terminal chambers 4 unless they undergo shear fracture.

Meanwhile, the male terminals 9 are inserted into their corresponding terminal chambers 3 of the male housing 1, and are caused to engage the lances 5. Then, the terminal seating detecting pieces 12*a* to 12*d* of the male-side lance support 15 are inserted into their corresponding detecting piece holding grooves 7. When the male-side lance support 15 is mounted normally in the male housing 1, the planar bodies 14*a* to 14*c* serve to protect the distal end portions 9*a* of the individual male terminals 9 located between the planar bodies or between the planar bodies and the skirt portion 1*b*. At the time of connection, therefore, the end edge of the skirt portion 2*b* of the female housing 2 is prevented from misguidedly entering the surrounded space 16 of the skirt portion 1*b* and striking against and deforming the distal end portions 9*a* of the male terminals 9 in the space 16.

Thus, the terminal seating detecting pieces 12*a* to 12*d* are formed integrally by means of the vertical ribs 13*a* to 13*c*, while the detecting pieces 21*a* to 21*d* are supported integrally on the frame 23. Therefore, the detecting pieces need not be inserted individually into the detecting piece holding grooves 7 and 8, and can be inserted collectively. Accordingly, the conditions of engagement of the terminals 9 and 18 can be detected collectively.

In the terminal chambers 3 and 4 of the male and female housings 1 and 2, moreover, the rubber plugs 11 and 20 are fitted in the cylindrical chambers 3*a* and 4*a*. Thus, the openings on the sides of the lead wires 10 and 19 are kept liquid-tight by the rubber plugs 11 and 20, respectively.

Subsequently, the skirt portion 1*b* of the male housing 1 is fitted into the gap 28 of the female housing 2, while engaging the guide rails 1*f* on the male-housing side with the guide groove 2*f* on the female-housing side, and the retaining hole 31*a* of the retaining piece 31 is caused to engage the projection 17. At this time, the skirt portion 1*b* is pressed against the seal ring 30 which is fitted in the gap 28, so that the openings on the sides of the connection-side end faces 1*c* and 2*c* are kept liquid-tight by the seal ring 30. Thus, the seal ring 30 and the rubber plugs 11 and 20 make the junction of the male and female terminals 9 and 18 watertight. The planar bodies 14*a* to 14*c* of the male-side lance support 15 are fitted into the vertical grooves 8*a* of the female housing 2 through their corresponding gap portions 27*a* to 27*c* of the female-side lance support 24. Guided by these planar bodies 14*a* to 14*c*, the respective distal end portions 9*a* of the male terminals 9 can be connected smoothly to their corresponding female terminals 18 without rubbing against one another.

The male-side lance support 15 may be divided into a plurality of parts in a state such that the terminal seating detecting pieces 12*a* to 12*d* and the planar bodies 14*a* to 14*c* are integral with one another. Also, the female-side lance support 24 may be divided into a plurality of parts in a state such that the detecting pieces 21*a* to 21*d* and the frame 23 are integral with one another.

Figure 12:
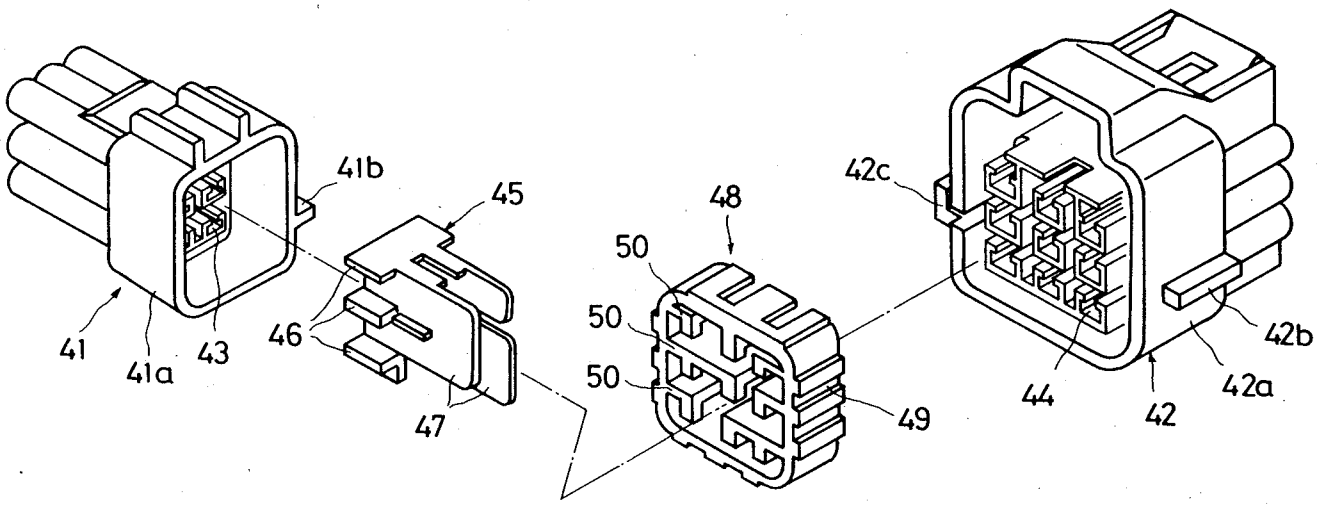
FIG. 12 is an exploded perspective view of an electrical connector device of a 9-terminal type according to a second embodiment of the invention.

FIG. 12 shows a second embodiment of the present invention applied to an electrical connector device of a 9-terminal type. In this second embodiment, a male housing 41 is formed with 9 terminal chambers 43 arranged in the form of a 3-row, 3-column matrix, and a female housing 42 is also formed with 9 terminal chambers 44. Terminal seating detecting pieces 46, arranged in three horizontal rows, are formed integrally on a male-side lance support 45 by means of vertical ribs extending at right angles thereto. Planar bodies 47, which serve to protect the distal end portions of male terminals, extend along the vertical ribs toward the female housing 42. On the other hand, terminal seating detecting pieces 50, arranged in three rows and supported by a frame 49, are formed integrally with a female-side lance support 48. Each of these detecting pieces 50 is cut to form a gap portion at an interference position, in order to avoid interfering with its corresponding planar body 47 of the male-side lance support 45.

The mounting of the male- and female-side lance supports 45 and 48 on the male and female housings 41 and 42 and the connection of the housings 41 and 42 are performed substantially in the same manner as in the case of the first embodiment, and can be easily inferred from the above description. Therefore, a detailed description of these operations is omitted herein.

The second embodiment shown in FIG. 12, however, differs from the first embodiment in that rubbing preventing projections 42*b* and 42*c* for male terminals are formed individually on opposite side walls of a skirt portion 42*a* of the female housing 42, substantially in the central position with respect to the vertical direction. Each of these projections 42*b* and 42*c*, which will be described in detail later, is recessed for a predetermined distance from the end face of the skirt portion 42*a*. The projection 42*c* on the left-hand side of FIG. 12 has a guide groove which is formed by slitting the skirt portion 42*a*. This guide groove is adapted to engage a guide projection 41b which is formed on the skirt portion 41a of the male housing 41, corresponding in position to the guide groove. These guide means serve to guide the male and female housings 41 and 42 so that they can be connected in correct positions.

For the ease of understanding, the function of rubbing preventing projections 56 (60) for male terminal, formed on a female housing 54 of an electrical connector device of a one-terminal type with a simpler construction, will be described with reference to the drawings of FIGS. 13 to 15 and 18, instead of describing the function of the projections 42b and 42c of the second embodiment shown in FIG. 12.

Figure 18:
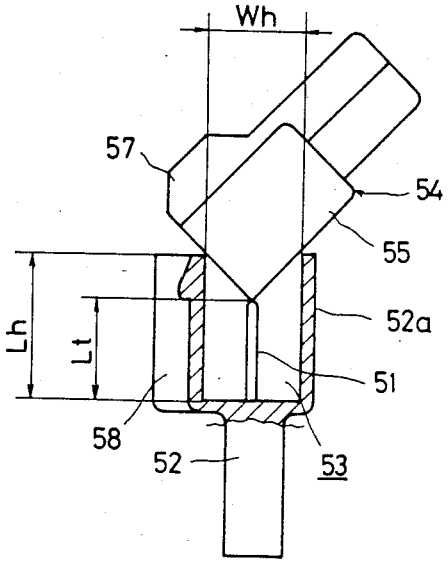
Fig.18 (PRIOR ART)
FIG. 18 is a side view, partially in section, showing relative positions of a skirt portion of a female housing and a male terminal in a state such that the female housing is not positioned correctly in a male housing, in a prior art electrical connector device of a one-terminal type.

Referring first to FIG. 18, a trouble or an awkward situation will be described which may be caused if the rubbing preventing projections 56 (60) are not provided for male terminal. A male terminal 51 contained in a male housing 52 is surrounded by a skirt portion 52a. There has conventionally been a problem such that the front end edge of a skirt portion 55 of a female housing 54, containing a female terminal (not shown) therein, slantly enters the inlet of a space 53 surrounded by the skirt portion 52a, i.e., an opening of the skirt portion 52a, thereby thrusting and deforming the male terminal 51, at the time of connector coupling. In FIG. 18, numeral 57 denotes a guide groove which is formed by bulging the top wall of the skirt portion 55 of the female housing 54. Numeral 58 denotes a guide projection which, protruding from the top wall surface of the skirt portion 52a of male housing 52, enables the male and female housings 52 and 54 to be correctly oriented when they are coupled together.

In order to prevent the male terminal 51 from being deformed by such a thrusting action, the distal end of the male terminal 51 must be recessed for a predetermined distance from the end face of the skirt portion 52a. The end edge of the female housing 54 penetrates most deeply into the space 53 when the inclination of the female housing 54 is 45°. If the width of the opening of the skirt portion 52a is Wh, the depth of penetration at that time is Wh/2. If the depth of the space 53 below the end face of the skirt portion 52a and the length or height of the male terminal 51 are Lh and Lt, respectively, the male terminal 51 can be prevented from being deformed by the thrusting action only if there is a relation $$Lh - Lt > Wh/2.$$

For secure electrical connection between the male and female terminals, the value Lt can be reduced only limitedly. In order to set (Lh−Lt) to a large value, therefore, the depth Lh from the end face of the skirt portion 52a must be made great. If the value Lh is increased, however, the length of the female housing 54, as well as that of the male housing 52, must also be increased. Thus, the electrical connector device may possibly be increased in size.

Figure 13:
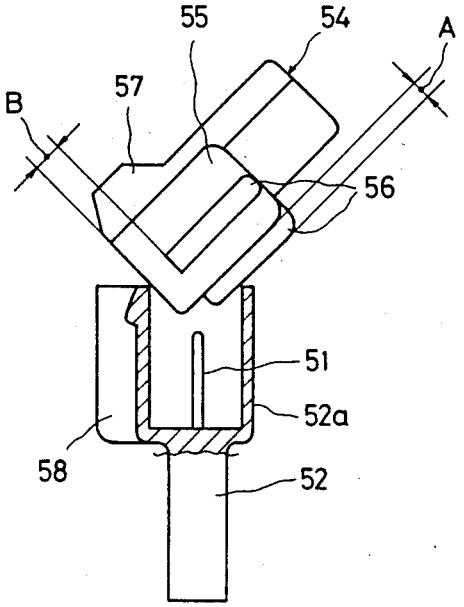
FIG. 13 is a side view, partially in section, showing relative positions of a skirt portion 55 of a female housing 54 and a male terminal 51 in a state such that the female housing 54 is not positioned correctly in a male housing 52, in an electrical connector device of a one-terminal type.
Figure 14:
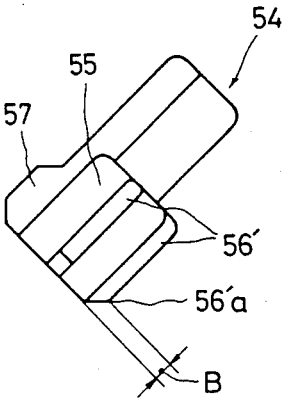
FIG. 14 is a side view showing modifications of rubbing preventing projections 56 and 60 for male terminals, formed on the outer wall of the skirt portion 55 of the female housing 54 shown in FIG. 13.
Figure 15:
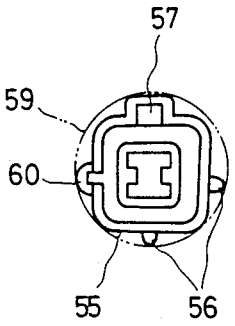
FIG. 15 is a front view of the female housing 54 shown in FIG. 13.

Referring now to FIGS. 13 to 15, the function of the rubbing preventing projections 56 (60) for male terminal, formed on the female housing 54, will be described. In these drawings, like reference numerals are used to designate the same components as are included in the electrical connector device shown in FIG. 18.

In this electrical connector device of a one-terminal type, the rib-shaped rubbing preventing projections 56 and 60 for male terminal individually protrude to a height A from two opposite side walls and the lower wall of the skirt portion 55 of the female housing 54, extending along the longitudinal direction of the housing 54. Each of the projections 56 (60) is recessed for a distance B from the end face of the skirt portion 55. Preferably, the recession distance B is equivalent to the height A of the projections 56 (60). As shown in FIG. 15, the projection 60, formed on the left-hand side wall of the skirt portion 55, has a guide groove which is formed by slitting the skirt portion 55. This guide groove is adapted to engage a guide projection (not shown) which is formed on the skirt portion 52a of the male housing 52, corresponding in position to the guide groove. Thus, the guide groove and projection serve also as guide means for insertion.

With use of the rubbing preventing projections 56 (60) on the skirt portion 55 of the female housing 54, as shown in FIG. 13, the end edge corner of the skirt portion 55, which abuts against the male terminal 51 at the deepest position in the prior art arrangement, is shifted horizontally for the distance A and upwardly (or toward the end face of the skirt portion 55) for a distance equal to $A/\sqrt{2}$. Therefore, the height Lh of the skirt portion 55 may be reduced, or the opening width Wh may be increased correspondingly.

In a modification shown in FIG. 14, a distal-end angle portion 56'a of each of rubbing preventing projections 56' is recessed for the distance B, and is connected to the end edge of the skirt portion 55 by means of a slanting surface. This slanting surface rises gradually from the end edge of the skirt portion 55 and attains the height A at the position recessed for the distance B.

The greater the height A of the projections 56 (60), the greater the effect of rubbing prevention by the projections 56 (60) will be. However, if the height A is restricted so that the projections 56 (60) are located within a circumscribed circle 59 about the whole periphery of the female housing 54 except the projections, as shown in FIG. 15, the electrical connector device can be inserted into a circular hole in the body of an automobile or the like, without being hindered by the projections.

With use of the rubbing preventing projections 42b and 42c on the female housing 42 of the electrical connector device of the second embodiment shown in FIG. 12, as seen from the above description, the planar bodies 47 of the male-side lance support 45 can be reduced in height, or the space between the planar bodies 47 can be widened. Further, these rubbing preventing projections can be effectively used for an electrical connector device with relatively few terminals.

What is claimed is:

1. An electrical connector device comprising:

a male housing formed with a plurality of male-terminal chambers adapted individually to contain male terminals;

a female housing formed with female-terminal chambers as many as said male-terminal chambers, said female-terminal chambers corresponding individually to said male-terminal chambers and adapted individually to contain female terminals connected to said male terminals corresponding thereto;

male-terminal seating detecting means; and female-terminal seating detecting means, said male housing including first retaining means, protruding in the form of a cantilever from each of partition walls, which define said male-terminal chambers of said male housing, and resiliently bendable in a first flexure space, whereby said male terminals contained in said male-terminal chambers are prevented from slipping out therefrom as said male terminals engage said first retaining means, said female housing including second retaining means protruding in the form of a cantilever from each of partition walls, which define said female-terminal chambers of said female housing, and resiliently bendable in a second flexure space, whereby said female terminals contained in said female-terminal chambers are prevented from slipping out therefrom as said female terminals engage said second retaining means, said male-terminal seating detecting means being adapted to be fitted into said first flexure space when said male terminals are contained in their corresponding male-terminal chambers in a manner such that said male terminals normally engage said first retaining means, and said female-terminal seating detecting means being adapted to be fitted into said second flexure space when said female terminals are contained in their corresponding female-terminal chambers in a manner such that said female-terminals normally engage said second retaining means, characterized in that:

said male-terminal seating detecting means includes at least one integral planar portion adapted to extend parallel to said male terminals, from a connection-side end face of said male housing toward said female housing, when said male-terminal seating detecting means is fitted normally in said first flexure space, an extended end of said planar portion being situated nearer to said female housing than the distal ends of said male terminals are, thereby protecting said male terminals from collision with objects running toward said male terminals; and said female housing has at least one fitting groove bored therein so as to open to a connection-side end face thereof and adapted to receive said planar portion.

2. An electrical connector device according to claim 1, wherein said terminals contained in said individual chambers for said male and female terminals each has an insulation barrel whereby said terminal is connected to a covered end of a conductor wire with the aid of a plug, said plug including a sleeve portion whose peripheral wall is clamped by said insulation barrel, a flange portion whose outer peripheral wall is in sliding contact with the inner surface of the peripheral wall of each said corresponding terminal chamber so that said terminal chamber is sealed in a liquid-tight manner, and a bore extending along the central axis of said plug and adapted to receive said covered end of said conductor wire, said sleeve portion being located on the terminal side and formed with a ring-shaped bank portion along the inner end edge of said bore, said bank portion having an inside diameter smaller than that of said bore.

3. An electrical connector device according to claim 1, wherein said male housing includes a first skirt portion extending from said connection-side end face thereof toward said female housing, surrounding said planar portion and the projecting ends of said male terminals projecting from said connection-side end face of said male housing, and adapted to be fitted on the outer periphery of said female-terminal chambers; said female housing includes a second skirt portion extending from said connection-side end face thereof toward said male housing and adapted to fitted on said first skirt portion; and at least one projection of a predetermined height extends on the outer surface of the peripheral wall of said second skirt portion, in a position recessed by a predetermined distance from the end face of said second skirt portion, on the opposite side to said male housing.

4. An electrical connector device according to claim 3, wherein the front end face of said projection is a slanting surface gradually rising from the front end edge of said second skirt portion and reaching said predetermined height at the position recessed by said predetermined distance.

5. An electrical connector device according to claim 1, wherein said male- and female-terminal chambers are arranged in the form of a matrix composed of a plurality of rows and a plurality of columns.

6. An electrical connector device according to claim 5, wherein said first flexure spaces corresponding to said male-terminal chambers in each said row communicate with one another so as to extend parallel to an array of said male-terminal chambers in said row.

7. An electrical connector device according to claim 6, wherein said male-terminal seating detecting means includes male-terminal seating detecting pieces adapted to be fitted into said first flexure spaces corresponding individually to said rows, said male-terminal seating detecting pieces being coupled together by means of at least one rib member extending at right angles thereto.

8. An electrical connector device according to claim 7, wherein said planar portion is formed so as to extend along said rib member at right angles to said male-terminal seating detecting pieces.

9. An electrical connector device according to claim 8, wherein said planar portion has a slit in the position where said planar portion interferes with said female-terminal seating detecting means.

10. An electrical connector device according to claim 5, wherein said second flexure spaces corresponding to said female-terminal chambers in each said row communicate with one another so as to extend parallel to an array of said female-terminal chambers in said row.

11. An electrical connector device according to claim 10, wherein said female-terminal seating detecting means includes female-terminal seating detecting pieces adapted to be fitted into said second flexure spaces corresponding individually to said rows, and a frame fitted around said plurality of female-terminal chambers and formed integrally with said female-terminal seating detecting pieces to support the same.

12. An electrical connector device according to claim 11, wherein each said female-terminal seating detecting piece is cut in the position where said female-terminal seating detecting piece interferes with said male-terminal seating detecting means, thereby forming a gap.

13. An electrical connector device according to claim 12, wherein at least one of said cut female-terminal seating detecting pieces is supported by a rib member crossing the same at right angles and having one end coupled to said frame.

* * * * *

US004806123B1

REEXAMINATION CERTIFICATE (3400th)

United States Patent [19]

[11] B1 4,806,123

Konishi et al.

[45] Certificate Issued Dec. 23, 1997

[54] ELECTRICAL CONNECTOR DEVICE WITH A NUMBER OF TERMINALS

[75] Inventors: Kenjiro Konishi, Hiratsuka; Ken Obata, Tokyo, both of Japan

[73] Assignee: Furukawa Electric Co., Ltd., Tokyo, Japan

Reexamination Request:
No. 90/004,379, Oct. 11, 1996

Reexamination Certificate for:

| | |
|---|---|
| Patent No.: | **4,806,123** |
| Issued: | **Feb. 21, 1989** |
| Appl. No.: | **149,107** |
| Filed: | **Jan. 27, 1988** |

[30] Foreign Application Priority Data

| | | | |
|---|---|---|---|
| Feb. 3, 1987 | [JP] | Japan | 62-13827 U |
| Feb. 4, 1987 | [JP] | Japan | 62-24274 |
| Mar. 9, 1987 | [JP] | Japan | 62-33150 U |

[51] Int. Cl.[6] ..... H01R 13/44

[52] U.S. Cl. ..... 439/595; 439/603

[58] Field of Search ..... 439/595, 594, 439/596, 603

[56] References Cited

U.S. PATENT DOCUMENTS

| | | | |
|---|---|---|---|
| 3,937,545 | 2/1976 | Cairns | 439/272 |
| 4,479,691 | 10/1984 | Smith | 439/595 |
| 4,557,542 | 12/1985 | Coller | 439/595 |
| 4,565,416 | 1/1986 | Rudy | 439/595 |
| 4,784,617 | 11/1988 | Oda | 439/595 |

FOREIGN PATENT DOCUMENTS

| | | |
|---|---|---|
| 0 147 956 | 7/1985 | European Pat. Off. . |
| 61-1666 | 1/1983 | Japan . |
| 58-198879 | 11/1983 | Japan . |
| 60-158575 | 8/1985 | Japan . |
| 60-249272 | 12/1985 | Japan . |
| 60-249273 | 12/1985 | Japan . |
| 61-1666 | 1/1986 | Japan . |
| 61-90174 | 6/1986 | Japan . |
| 3-47261 | 12/1987 | Japan . |
| 62-195987 | 12/1987 | Japan . |

*Primary Examiner*—Neil Abrams

[57] ABSTRACT

An electrical connector device comprising male and female housings and terminal seating detecting means. Each of the housings includes retaining means protruding in the form of a cantilever from each of partition walls, which define terminal chambers arranged in the form of a matrix composed of a plurality of rows and columns, and resiliently bendable in a flexure space. As male terminals, contained individually in the terminal chambers, and female terminals, adapted to be connected to the male terminals, engage the retaining means, the terminals are prevented from slipping out of the chambers. The terminal seating detecting means is fitted into the flexure space of the retaining means when the terminals are contained in their corresponding terminal chambers so that they normally engage the retaining means. The detecting means for the male terminals is formed integrally with at least one integral planar portion for protecting the male terminals from collision with objects running toward them, and the female housing has a fitting groove bored therein and adapted to receive the planar portion.

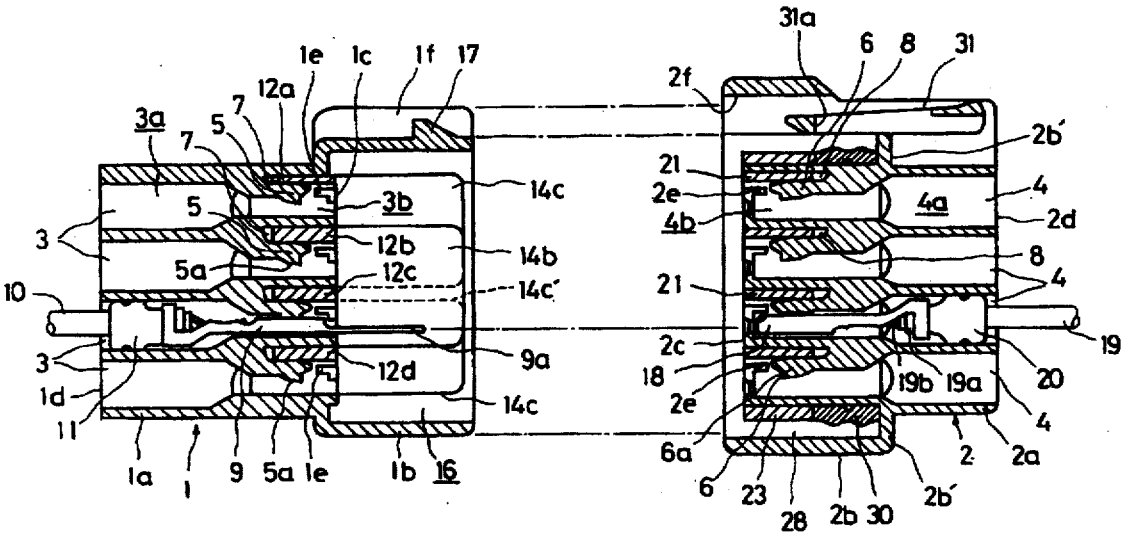

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–13, dependent on an amended claim are determined to be patentable.

1. An electrical connector device comprising:

a male *terminal* housing formed with a plurality of male-terminal chambers adapted individually to contain male terminals;

a female *terminal* housing formed with female-terminal chambers as many as said male-terminal chambers, said female-terminal chambers corresponding individually to said male-terminal chambers and adapted individually to contain female terminals connected to said male terminals corresponding thereto;

male-terminal seating detecting means; and female-terminal seating detecting means, said male *terminal* housing including first retaining means, protruding in the form of a cantilever from each of partition walls, which define said male-terminal chambers of said male *terminal* housing, and resiliently bendable in a first flexure space, whereby said male terminals contained in said male-terminal chambers are prevented from slipping out therefrom as said male terminals engage said first retaining means, said female *terminal* housing including second retaining means, protruding in the form of a cantilever from each of partition walls, which define said female-terminal chambers of said female *terminal* housing, and resiliently bendable in a second flexure space, whereby said female terminals contained in said female-terminal chambers are prevented from slipping out therefrom as said female terminals engage said second retaining means, said male-terminal seating detecting means being adapted to be fitted into said first flexure space when said male terminals are contained in their corresponding male-terminal chambers in a manner such that said male terminals normally engage said first retaining means, and said female-terminal seating detecting means being adapted to be fitted into said second flexure space, *when said male and female terminal housings are not connected to one another, and* when said female terminals are contained in their corresponding female-terminal chambers in a manner such that said female-terminals normally engage said second retaining means, characterized in that:

said male-terminal seating detecting means includes at least one integral planar portion adapted to extend parallel to said male terminals, from a connection-side end face of said male *terminal* housing toward said female *terminal* housing, when said male-terminal seating detecting means is fitted normally in said first flexure space, an extended end of said planar portion being situated nearer to said female *terminal* housing than the distal ends of said male terminals are, thereby protecting said male terminals from collision with objects running toward said male terminals, *wherein said male terminal seating detecting means includes a generally planar wall portion connected in a generally perpendicular relationship to said planar portion and being parallel with said male terminals and closely positioned in said first flexure space;* and said female *terminal* housing has at least one fitting groove bored herein [so as to] open to a connection-side end face thereof and adapted to receive said planar portion.

* * * * *